US010015999B2

(12) United States Patent
Semyrog et al.

(10) Patent No.: US 10,015,999 B2
(45) Date of Patent: Jul. 10, 2018

(54) SWADDLE CONFIGURED BLANKET

(71) Applicants: Serge Semyrog, Matthews, NC (US); Tatyana Medvedev Semyrog, Matthews, NC (US)

(72) Inventors: Serge Semyrog, Matthews, NC (US); Tatyana Medvedev Semyrog, Matthews, NC (US)

(73) Assignee: BowBaby LLC, Charlotte, NC (US)

( * ) Notice: Subject to any disclaimer, the term of this patent is extended or adjusted under 35 U.S.C. 154(b) by 466 days.

(21) Appl. No.: 14/725,947

(22) Filed: May 29, 2015

(65) Prior Publication Data

US 2016/0345637 A1 Dec. 1, 2016

(51) Int. Cl.
*A41B 13/06* (2006.01)

(52) U.S. Cl.
CPC ..... *A41B 13/06* (2013.01)

(58) Field of Classification Search
CPC .... A41B 13/06; A41B 13/065; A47G 9/0207; A47G 9/0223; A47G 9/083
See application file for complete search history.

(56) References Cited

U.S. PATENT DOCUMENTS

| | | | | | |
|---|---|---|---|---|---|
| 1,811,632 | A * | 6/1931 | Hummel | A41B 13/06 | 2/69 |
| 2,683,267 | A * | 7/1954 | Weil | A47D 15/02 | 5/482 |
| 4,979,250 | A * | 12/1990 | Troncone | A41B 13/06 | 2/69 |
| 5,797,144 | A * | 8/1998 | Ciccone | A44B 6/00 | 2/144 |
| D606,282 | S * | 12/2009 | Chen | D2/719 | |
| 8,707,481 | B1 * | 4/2014 | Juarez | A47G 9/066 | 2/69 |
| 2003/0079267 | A1 * | 5/2003 | Dugan | A41B 13/06 | 2/69 |

* cited by examiner

*Primary Examiner* — Eric J Kurilla

(57) ABSTRACT

A swaddle-configured blanket having four edges including a first edge having a first length, a second edge parallel to the first edge having a second length different than the first length, a third edge coupled to the first edge and the second edge, the third edge forming a first corner with the second edge, and a fourth edge coupled to the first edge and the second edge, the fourth edge forming a second corner with the second edge. The first corner and the second corner being configured to tie into a knot.

6 Claims, 13 Drawing Sheets

SWADDLE CONFIGURED BLANKET

TECHNICAL FIELD

The present disclosure generally relates to cloth material and other threaded materials that can be shaped or folded into other objects. More specifically, the present disclosure relates to a specifically configured blanket that can be wrapped or folded into a swaddle so as to securely wrap an infant without the need for additional components such as zippers, velcro, flap ties or any such adhesive elements.

BACKGROUND

Swaddles are wrapped-up blankets that securely enclose an infant, so as to make the infant warm and assist in the clothing, feeding, falling to sleep and the staying asleep of the infant. Swaddles also make it possible for a parent, such as a mother, to carry the infant more comfortably once the infant is enclosed in the swaddle. A completely unswaddled infant is harder to handle with both arms and especially with one arm, and infants are usually easier to handle once wrapped in swaddles. However, conventional swaddles lack the advantage of a parent being able to conveniently handle an infant, once wrapped in the swaddle, with one arm on one side and still being able to perform other tasks with a free arm such as bottle-feeding the infant, talking on the phone, writing or taking notes, or other similar tasks that can be performed with a single arm.

Swaddles that currently exist on the market also often utilize additional and unnecessary components such as zippers, velcro, flap ties and other adhesive elements to secure the threaded material or cloth of the swaddle around the infant. However, such components may become loose and worse, may even harm the infant or may not be conducive to the infant's sleep. For instance, velcro may irritate the infant's skin and is very loud when released, and zippers may be inadvertently swallowed by infants, or break apart as to create a dangerous, ragged gap in which the infant can harm its hands or feet. Zippers also make a loud noise when being zipped or unzipped, and can also cause harm to the infant if it catches the infant's skin or finger. Furthermore, such additional components require additional manufacturing costs, making the overall products incorporating them very expensive and unaffordable for typical families raising young infants.

In addition, typical pieces of cloth—such as a square or rectangular blanket—are not ideally configured to be swaddles because they are either too small to wrap the infant in or not shaped correctly so as to create a snug and secure swaddle. As a result, the infant can easily wiggle out of a swaddle that is made of a blanket that is too small because there is not enough blanket material to completely enclose and secure the infant. Furthermore, such blankets with insufficient material do not have reinforcements to form a secure swaddle. The corners of such small blankets may also frequently become un-tucked and loose. When carrying a baby in such a small blanket, the corners also start to hang loosely, un-securing the infant, and further creating a dangerous situation where the blanket can be tangled up with the infant within it. Moreover, if users were to purchase larger versions of square or rectangular cloths, there may be excessive amounts of cloth left over when they are folded into swaddles, which leads to a wasting of material. Also, the infant may become too warm within unnecessary layers of material without the ability to easily remove such layers.

SUMMARY

A swaddle-configured blanket having four edges includes includes a first edge having a first length, a second edge parallel to the first edge having a second length different than the first length, a third edge coupled to the first edge and the second edge, the third edge forming a first corner with the second edge, and a fourth edge coupled to the first edge and the second edge, the fourth edge forming a second corner with the second edge. The first corner and the second corner being configured to tie into a knot.

A method of forming a swaddle for an infant out of a swaddle-configured blanket, the method includes placing the infant on an upper portion of the swaddle-configured blanket, the swaddle-configured blanket having a first corner and a second corner. The method also includes wrapping the first corner around in front of the infant to form a first layer. The method further includes wrapping the second corner around in front of the first layer to form a second layer. The method also includes folding up a bottom edge of the swaddle-configured blanket to form a third corner and a fourth corner. The method further includes wrapping the third corner behind the second layer in a first direction to form a third layer and a flipside of the third corner. The method also includes wrapping the fourth corner behind the third layer in a second direction different from the first direction to form a fourth layer and a flipside of the fourth corner. The method further includes tying the flipside of the third corner and the flipside of the fourth corner into a knot that forms the swaddle around the infant.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

Figure 1A:
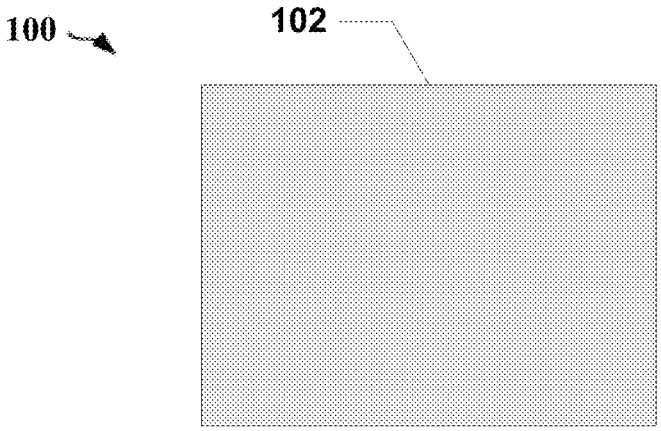
FIG. 1A (PRIOR ART)
FIGS. 1A-1D show conventional swaddles that may be used as prior art.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

According to an aspect of the disclosure, a swaddle-configured blanket provides an inexpensive piece of material that can be easily folded into a swaddle with a knot to safely secure an infant without having to use external or additional components such as zippers, velcro, tie flaps or other such adhesive elements. That is, all the elements required for forming the secure swaddle are included with the swaddle-configured blanket. The swaddle-configured blanket is also cut and shaped at specific proportions so as to be configured to be the tightest-fitting and most efficiently secure swaddle for the infant. That is, there is sufficient cloth material in the swaddle-configured blanket to form a secure swaddle, and also no cloth material is wasted. The knot of the swaddle can also be configured to be on the right side or left side, so that the knot does not press against the baby while being held closely to the caretaker's body and causing discomfort to the baby. With the swaddle being completely secure and tied, this allows a parent to hold the swaddled infant with one arm and perform tasks such as bottle-feeding, cooking, writing notes, talking on the phone, and so on, with the other arm. If the infant becomes too warm or uncomfortable with excessive layers of clothing, the swaddle can be easily and quickly untied by untying the knot, which takes mere seconds. The untying and tying of the knot is also quiet and done without sound, unlike the sounds caused or emitted by velcro or zippers, which wakes the baby up. The swaddle-configured blanket carries with it a number of advantages.

First, the actual design of the pattern of the fabric is an advantage of the swaddle-configured blanket because the fabric material allows (1) the existence of loose ends that can be tied into a knot around the arms of an infant for snugness and to prevent an infant from removing his/her arms from the swaddle, which help them to sleep better, and (2) the fabric used to make the swaddle-configured blanket allows consumers and manufacturers to save on the amount of material used per swaddle, as overall there is less material used per blanket because of how the loose ends are ultimately formed.

The swaddle-configured blanket is also not just a standard square, neither is it a square with tapered tails on the bottom. In one implementation, the sides of the swaddle-configured blanket come in towards the bottom a value, for example 9 inches before they flare out again to form the tails. This innovative shape serves three purposes. (a) It removes the accumulation of bulk that gets created with too much fabric around the infant's leg area. Too much fabric means overheating. (b) The shape makes the tails more effective at creating that bow/knot at the end. Too much fabric also doesn't allow for a good bow, which will make the tightening of the swaddle ineffective. (c) The shape saves on cost of production. If the sides came down straight and then went into a tail it would mean savings of, for example, nine (9) extra inches in fabric.

Also, for a newborn infant, a fold can be performed at the top of the fabric of the swaddle-configured blanket in order to shorten the height and adjust the dimensions for a smaller and/or younger baby. If the infant is older and slightly larger, then there is no need to perform the fold, and the full height of the swaddle-configured blanket may be used to securely wrap the infant in a swaddle.

Second, another advantage of the swaddle-configured blanket is its knot or its bow and its positioning, which (1) helps achieve snugness for the swaddle without the use of velcro, zippers, flaps or other external adhesive material and (2) allows for total control of the snugness that a user wants and the high customability of snugness, which cannot be achieved with velcro, zippers, flaps, or other similar adhesive elements, as fabric stretches over time and after a couple of washes becomes loose. The (3) knots or bows also serve is at the same time an attractive decorative or ornamental feature—e.g., the knot can be tied into a beautiful bow tie—which can further be customized in color, shape and design due to special occasions such as holidays (Christmas, Easter, Halloween), birthdays, different seasons, different environments (outdoor, different sports, indoors), other celebrations requiring formal wear, and so on and so forth. The knot or bow can also be integrated into the marketing and packaging of the swaddle-configured blanket. For example, a 3D package may be manufactured showing the swaddle-configured blanket already folded into a swaddle, with a bow tied to it that will protrude to the outside of the package, and which may be further enhanced with other visual style (bright colors, different colors for different holidays, sales, or other occasions, glow-in-the-dark colors, silver/gold/metallic colors, and so on). This way, the packaging of the swaddle-configured blanket will be visual as well as tactile. Furthermore, (4) the knots can be customized so as to be placed on any side or portion (left, right) of the swaddle, so as to not cause discomfort to the baby by having the tied knot press against the baby when being held. A fully secured and tied swaddle also allows a parent to hold the swaddled infant in one arm, and perform tasks—such as bottle-feeding, cooking, talking on the phone, taking notes, and so on—with their other free arm.

By forming a knot or bow that does not require zippers, velcro, flaps or other adhesive materials, the advantage is that a quiet securing apparatus is formed. The knot is not noisy like zippers or velcro, which can wake the infant while it is sleeping. Furthermore, zippers, velcro or flaps can create opportunities for the infant to injure itself (e.g., fingers or feet can be caught in zippers or velcro, velcro may irritate skin) or break the adhesive materials as well. For example, zippers get broken all the time and immediately lose their functionality. Velcro wears away with time and with each wash, and a single swaddle will get at least 3 washes per week, which wears out the Velcro very quickly. This additional hardware (zippers, velcro, flaps) also requires further manufacturing costs and simply adds needless price to a blanket that should be cheap and relatively inexpensive to begin with. Therefore, the swaddling-configured blanket provides an all-in-one solution that contains all of its securing elements within the single robust package of the swaddling-configured blanket itself, without the need to purchase or incorporate unnecessary hardware or adhesive components that could do more harm than good.

Creating the knot/bow on the right side, left side, top side, or bottom side has to do with how the tail ends are offset before the bottom half or bottom edge of the swaddling-configured blanket is flipped over the baby. See FIG. 4D for further reference. This is important because some people (doctors, parents, nurses) many only hold the baby on the left arm, some on the right. For examinations, some infants are only held by the left arm. It also has to do with whether the holding individual is a lefty or a righty. Furthermore, the knot/bow should not be in the way of the infant, which creates discomfort for said infant. For example, if the infant is held in the left arm, the infant is pressing against the left side of the body of the holder. That means that the knot should be only on the left or the center of the infant's body. The opposite applies to someone who holds an infant in their right arm, and similar principles apply to the top/bottom portions of the swaddle.

The knot also provides further reinforcement for the baby's arms to stay put. For best results, the knot should be placed at, but not below the infant's elbows. Therefore, the knot is there for aesthetic purposes as well as to provide sufficient tightness for swaddling and the securing of the infant's arms. A baby is able to wiggle out of a swaddle easily if the elbows are loose. Therefore, securing the elbows is key.

Third, another advantage of the swaddle-configured blanket is the ability of certain fabric to stretch one way and not to stretch in another way. For instance, the swaddle-configured blanket will be cut out of such material that will allow top-to-bottom stretching but will not allow sideways stretching in order to provide for more robust snugness in the finished swaddle.

The ideal fabric for this blanket would be a woven cotton such as jersey. However, other types of material that can make up the swaddle-configured blanket include muslin, flannel and other woven fabrics, although it is not limited to just these cloth materials alone and can encompass the most recent thread-based materials available. Provided below are also merely examples and different scenarios that explain functionality and advantages of the swaddle-configured blanket.

In one implementation, the swaddle-configured blanket is made out of 100% woven cotton, such as, jersey material. The fabric may be 100% cotton, and also may be made of organic cotton. Most commercially available swaddles are made of flannel or muslin. A woven fabric such as jersey is a fabric that is synonymous with comfort, ease and softness. Jersey is also less likely to cause overheating compared to flannel, yet it is more comfortable in feeling compared to muslin. Jersey also contains a necessary traction against itself that will maintain snugness so that the arms of the infant will not easily get out.[13] As a material, however, jersey stretches in one way (e.g., vertical) but doesn't stretch in another way (e.g., horizontal). For the swaddle-configured blanket to be an effective, tight swaddle so that the infant will not be able to wiggle his or her arms out of the swaddle, the infant should be placed perpendicularly to the direction of stretch in a cloth material. A major complaint amongst parents about swaddling is the swaddle not being tight enough to keep the arms of the infant within the swaddle. Therefore, for strong snugness in a swaddle, the stretch of the blanket material used to form the swaddle extends in one direction (e.g., vertically) while the baby is placed perpendicularly against that direction in another direction (e.g., horizontally). This way, a tight swaddle with extra safety is achieved with a desirable fabric such as jersey.

The pattern of the clothing material making up the swaddle-configured blanket may be made in a variety of different designs, including polka dots, single colors, two or three main colors, stripes, grids, shapes, animal or character prints, and so on.

One of the concerns that may come with swaddling is that it may contribute to hip dysplasia of the infant because the lower region of the body is being excessively constrained, if swaddled incorrectly. The swaddle-configured blanket is safe because according to various techniques, such as the Hip Healthy Swaddling technique, the swaddle-configured blanket gives freedom and ease for the infant's legs to move and be resting in the position they were resting in within the womb. This is ensured in that the tightness of the swaddle from the swaddle-configured blanket focuses on the upper body and the arms of the infant, and does not focus at all in the infant's hip or leg areas. Furthermore, the above-described vertical stretch feature is an added bonus that provides extra comfort for the baby to kick and move its legs freely.

Infants should also be swaddled until the age of 4-5. It is also beneficial to swaddle the infant more during younger ages and less as the infant gets older. Infants also become more mobile during the passage of four months and for safety reasons, such a timeline should be roughly followed.

Safety wise, infants should never be swaddled too tight in that the knot/bow should not be tied too tight or excessively tight. Parents will know the right level of tightness for the knot/bow, but it will be apparent from experience, because even a simple knot will be tight enough to secure the infant in a swaddle. Neither should the bow/tie be tied above the elbows of the infant. This is important not only for the purpose of effective smugness but also because it is potentially unsafe for the tie to be higher and any closer to the infant's neck. As the baby wiggles within the swaddle, the bow/tie can potentially move up or down. If the bow/tie is above the infant's elbows, then the bow/tie has a likelihood of coming too close to the infant's neck and thus creating an unsafe situation. To the extent necessary, carefully-worded instructions and marketing materials will ensure the proper level of tightness for the knot of the swaddle made by the swaddle-configured blanket.

FIGS. 1A-1D show conventional swaddles that may be used as prior art. FIG. 1A is a diagram 100 that shows a conventional square blanket 102. The conventional square blanket 102 has the problem of not providing enough material for a secure-enough swaddle for an infant. In that case, the infant's arms will not be secure and the infant will be able to easily remove his or her arms from the swaddle, defeating the whole purpose of the swaddle in the first place. The conventional square blanket 102 may also be made of excessive amounts of material, which would lead to overheating and accumulation of bulk around the infant's leg areas. This material, in addition to making the infant feel uncomfortable, is also wasted.

Figure 1B:
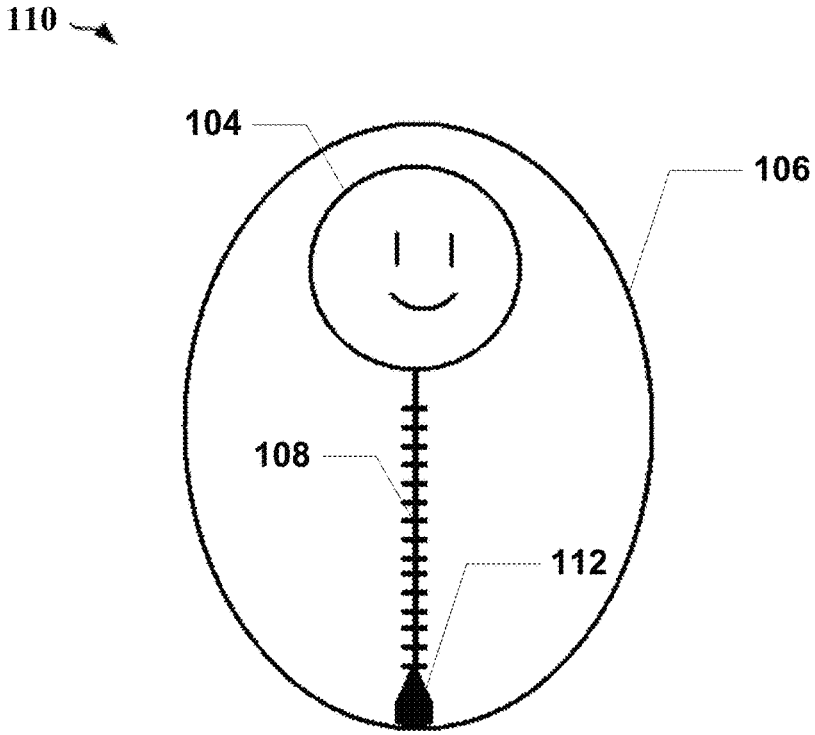
FIG. 1B (PRIOR ART)
Figure 1C:
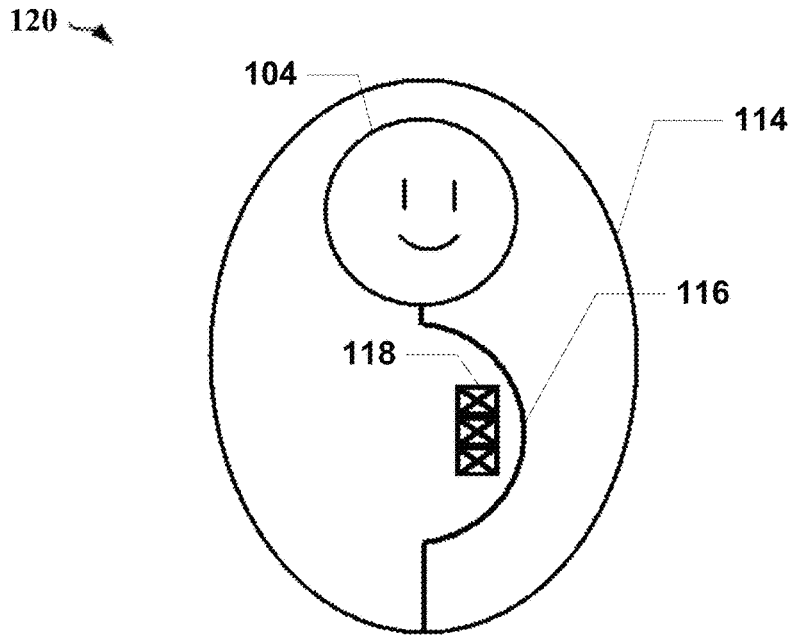
FIG. 1C (PRIOR ART)

FIG. 1B is a diagram 110 that shows a zipper-equipped swaddle 106 that includes an infant 104, a zipper 112 and a zipper track 108. The zipper 112 and zipper track 108 make up the only way in which the infant 104 is secured within the swaddle 106. The zipper 112 and zipper track 108 could break, leaving a dangerous gap in which the hands or feet of the infant 104 may get caught in, leading to injury of the infant 104. The infant 104 may also inadvertently swallow the zipper 112 or other small components making up the zipper track 108. The zipper track 108 may also irritate the skin of the infant 104. The main nuisance about the zipper 112 and the zipper track 108 is the loud sound the components make when being zipped and unzipped. Such a loud sound can wake or disturb the infant 104. In addition, the manufacturing cost of adding hardware such as a zipper 112 and a zipper track 108 may be needlessly expensive, and can add unwanted price value to an object that should be relatively cheap and inexpensive to begin with. High replacement costs may also be necessary if components (such as the zipper 112 or zipper track 108) become broken. Therefore, it is clear that the zipper 112 and zipper track 109 of the zipper-equipped swaddle 106 brings about a number of problems FIG. 1C is a diagram 120 that shows a velcro-equipped swaddle 114 enclosing an infant 104 with at least one flap 116 having a velcro adhesive surface 118. The velcro adhesive surface 118 meets another velcro adhesive surface (not shown) or contact material in order to form a velcro connection that secures the infant 104 within the velcro-equipped swaddle 114. However, the velcro connection is not that strong. Furthermore, the velcro adhesive surface 118 may irritate the skin of the infant 104. In addition, the noise caused by adhering and unadhering the velcro adhesive surface 118 may be loud and a distraction to the infant 104, causing the infant 104 to wake up or be disturbed. The velcro adhesive surface 118 and additional flaps 116 may also add unwanted manufacturing costs to a swaddle that should be relatively cheap and inexpensive to begin with. High replacement costs may also be necessary if components such as the velcro adhesive surface 118 or any of the flaps 116 become broken. Therefore, it is clear that the velcro adhesive surface 118 of the velcro-equipped swaddle 114 brings about a number of problems.

Figure 1D:
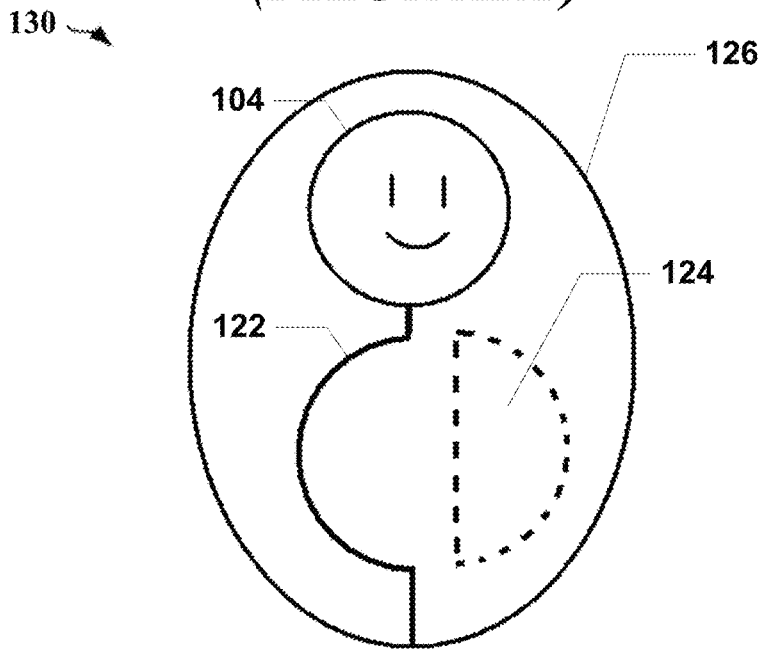
FIG. 1D (PRIOR ART)

FIG. 1D is a diagram 130 that shows a flap-equipped swaddle 126 enclosing an infant 104 with at least one first securing flap 122 and at least one second securing flap 124. The securing flaps 122 and 124 work together to form a securing mechanism that tightens the flap-equipped swaddle 126 around the infant 104. However, removing the flaps 122 and 124 may be cumbersome and take time, which is inconvenient when, for example, the infant 104 needs to go to the bathroom. Furthermore, because the flaps 122 and 124 are arranged around the hips of the infant 104, there is risk of hip dysplasia and other problems that the infant 104 may experience. The flaps 122 and 124 may also make the flap-equipped swaddle 126 too warm for the infant 104, which might be extremely uncomfortable especially if there is no quick and easy way to conveniently undo and remove the flaps 122 and 124. Furthermore, the added manufacturing costs of integrating the flaps 122 and 124, any necessary flap inserts or flap holes would increase the price, as well as the amount of material needed to construct the flap-equipped swaddle 126, therefore adding unnecessary costs to a swaddle that should be relatively cheap and inexpensive to begin with. Therefore, it is clear that the flaps 122 and 124 of the flap-equipped swaddle 126 brings about a number of problems.

Figure 2A:
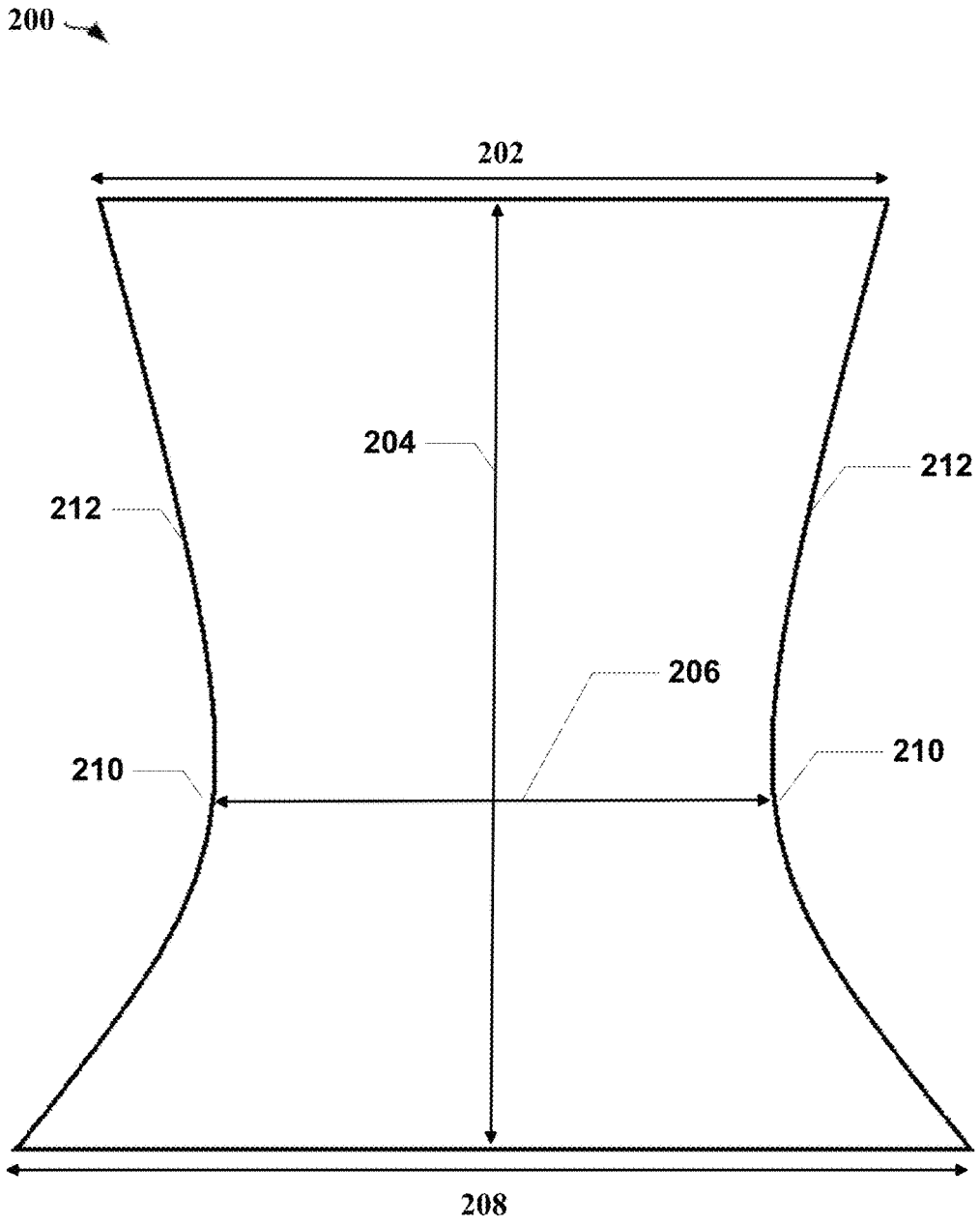
FIGS. 2A-2C show different swaddle-configured blankets according to aspects of the disclosure.
Figure 2B:
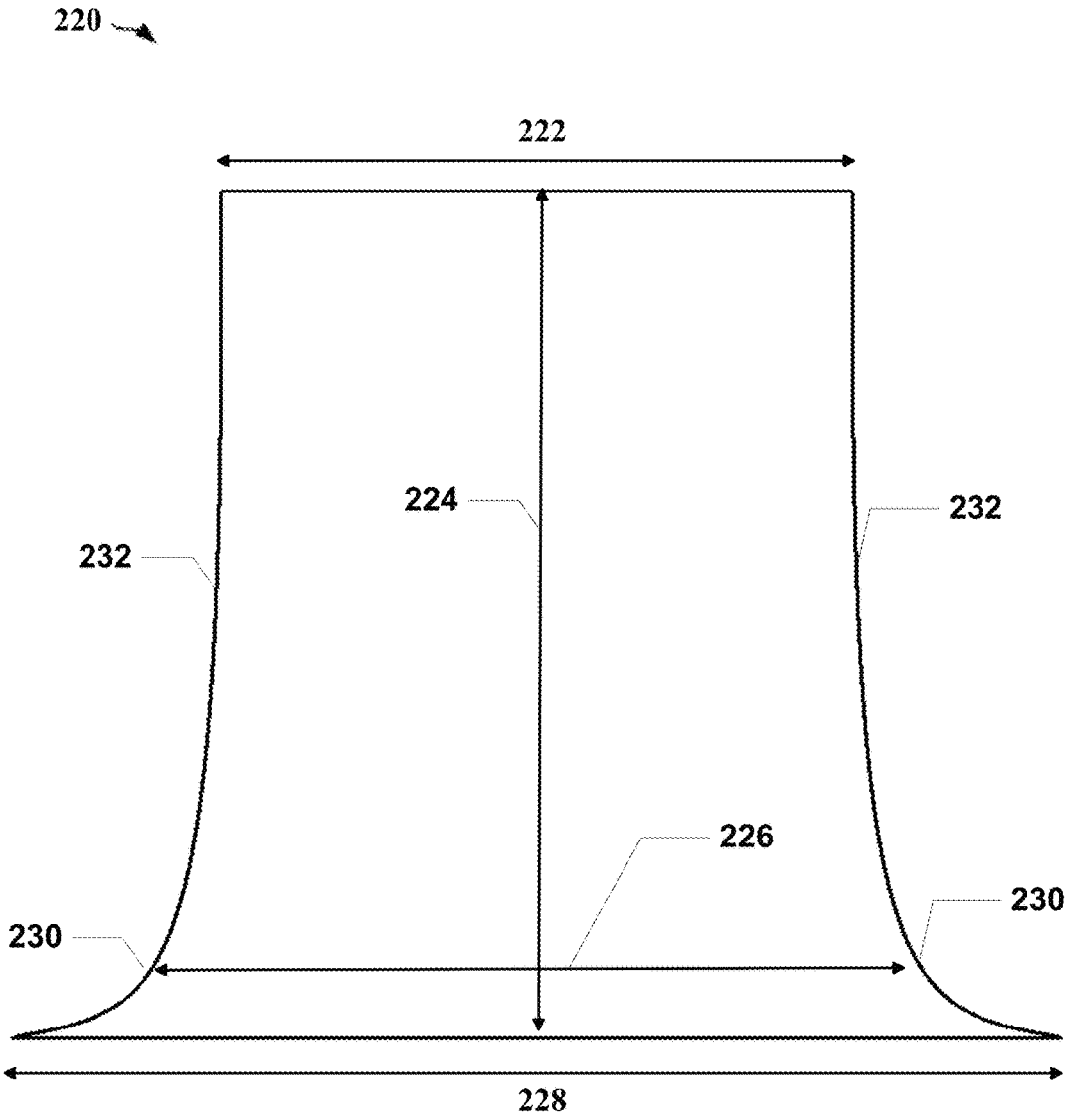
Figure 2C:
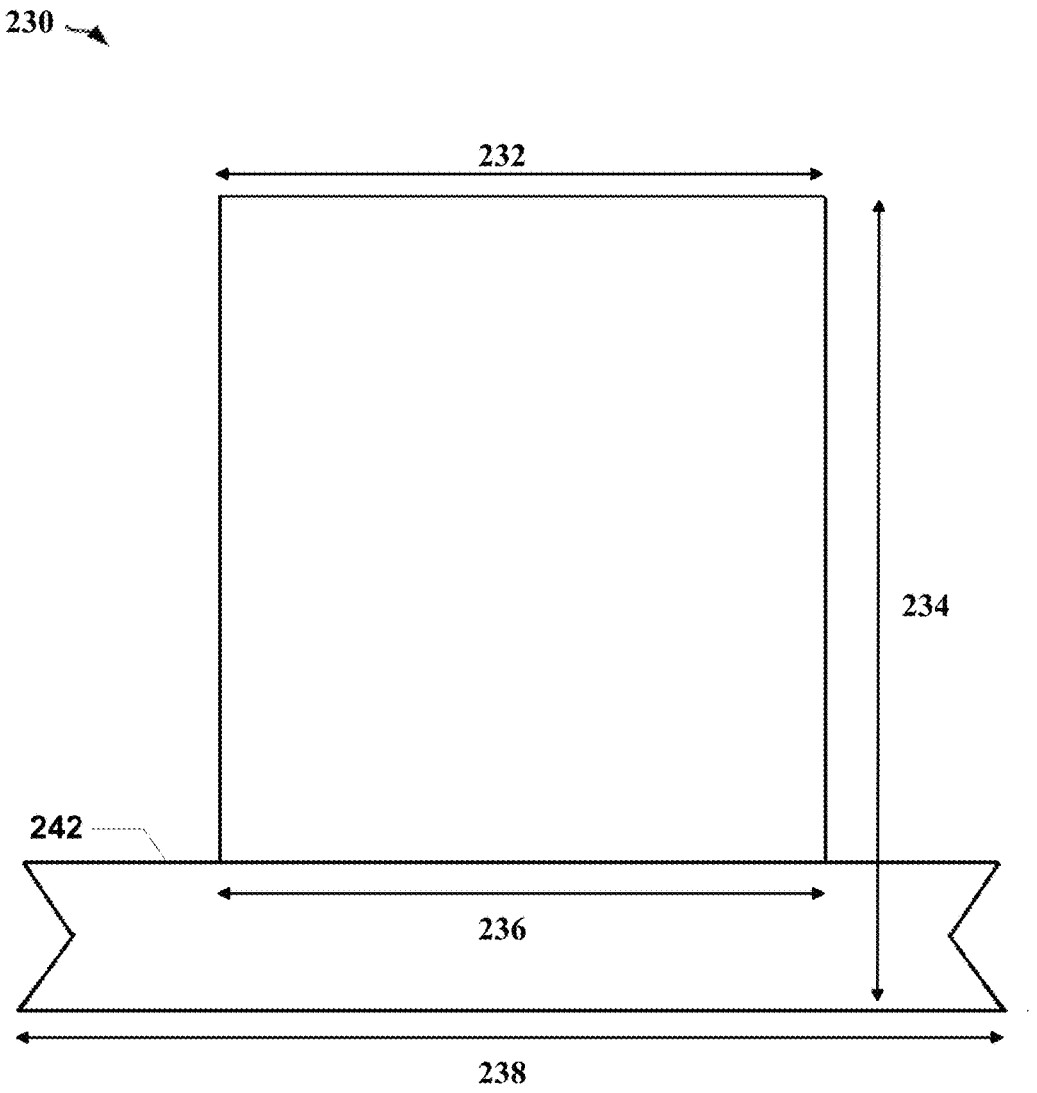

FIGS. 2A-2C show different swaddle-configured blankets according to aspects of the disclosure. The swaddle-configured blankets shown in FIGS. 2A-2C solve the problems presented in the prior art by being completely self-contained solutions that can securely wrap an infant in a swaddle without the need of additional components such as zippers, velcro, flaps or any similar adhesive elements.

FIG. 2A shows a main design of a swaddle-configured blanket 200 that includes a variety of dimensions such as a top width 202, a bottom width 208, a height 204, and a turning point span 206. The curves 212 may curve towards the middle of the swaddle-configured blanket 200. In one implementation, the curves 212 may include a third edge and a fourth edge, while the top width 202 is the width of a first edge and the bottom width 208 is the width of a second edge. Each of the curves 212 has its own turning point 210, or low-point, or point in which the curve changes from one direction (curving downwards) to another direction (curving upwards). In the case of FIG. 2A, the turning points 210 are the most inwardly located points of the curves 212 in that the turning points 210 are closest to the middle of the swaddle-configured blanket 200. The turning point span 206 is the distance between the two turning points 210. In one implementation, the top width 202 is approximately 42 inches, the bottom width 208 is approximately 59 inches, the height 204 is approximately 42 inches, and the turning point span 206 is 33 inches. The ultimate dimensions of the main design of the swaddle-configured blanket 200 may be multiples or values in proportion to the estimated values provided in this implementation. Furthermore, instead of inches, the units may also be centimeters, or dimensional units that would make sense with the size of an average infant.

FIG. 2B shows a modified design of a swaddle-configured blanket 220 that includes a variety of dimensions such as a top width 222, a bottom width 228, a height 224, curves 232, and a turning point span 226. In one implementation, the curves 232 may include a third edge and a fourth edge, and the top width 222 is the width of a first edge and the bottom width 228 is the width of a second edge. Each of the curves 232 has its own turning point 230, which is the point on the curve where slightly downward (or upward) changes to slightly upward (or downward). The turning point span 226 is the distance between the two turning points 230 of the two curves 232. In the case of FIG. 2B, the curves 232 curve outwards away from the middle of the swaddle-configured blanket 220 and more so towards the bottom of the swaddle-configured blanket 220, near the bottom width 228. In one implementation, the curves 232 resemble the structure of an inverted candy-cane or inverted hook. In one implementation, the top width 222 is approximately 42 inches, the bottom width 228 is approximately 59-70 inches, the height 204 is approximately 42 inches, and the turning point span 226 is approximately 42 inches as well. The ultimate dimensions of the modified design of the swaddle-configured blanket 220 may be multiples or values in proportion to the estimated values provided in this implementation. Furthermore, instead of inches, the units may also be centimeters, or dimensional units that would make sense with the size of an average infant.

FIG. 2C shows a ribbon design of a swaddle-configured blanket 230 that includes a variety of dimensions such as a top width 232, a bottom width 236, a ribbon width 238, and a height 234. The ribbon 242 is a component that adorns the bottom of the ribbon design of the swaddle-configured blanket 230 that can be used as an ornament or decorative component. Such an ornament may also play a role in 3D packaging of the swaddle-configured blanket 230, if desired. The ribbon 242 can also be cut out of silk, velvet, cotton, nylon, polyester, polyproylene, light metals, plastic, and any cloth material. In one implementation, the top width 232 is approximately 42 inches, the bottom width 236 is approximately 42 inches, the height 234 is approximately 42 inches and the ribbon width 238 is approximately 59-70 inches. The ultimate dimensions of the ribbon design of the swaddle-configured blanket 230 may be multiples or values in proportion to the estimated values provided in this implementation. Furthermore, instead of inches, the units may also be centimeters, or dimensional units that would make sense with the size of an average infant.

Figure 3A:
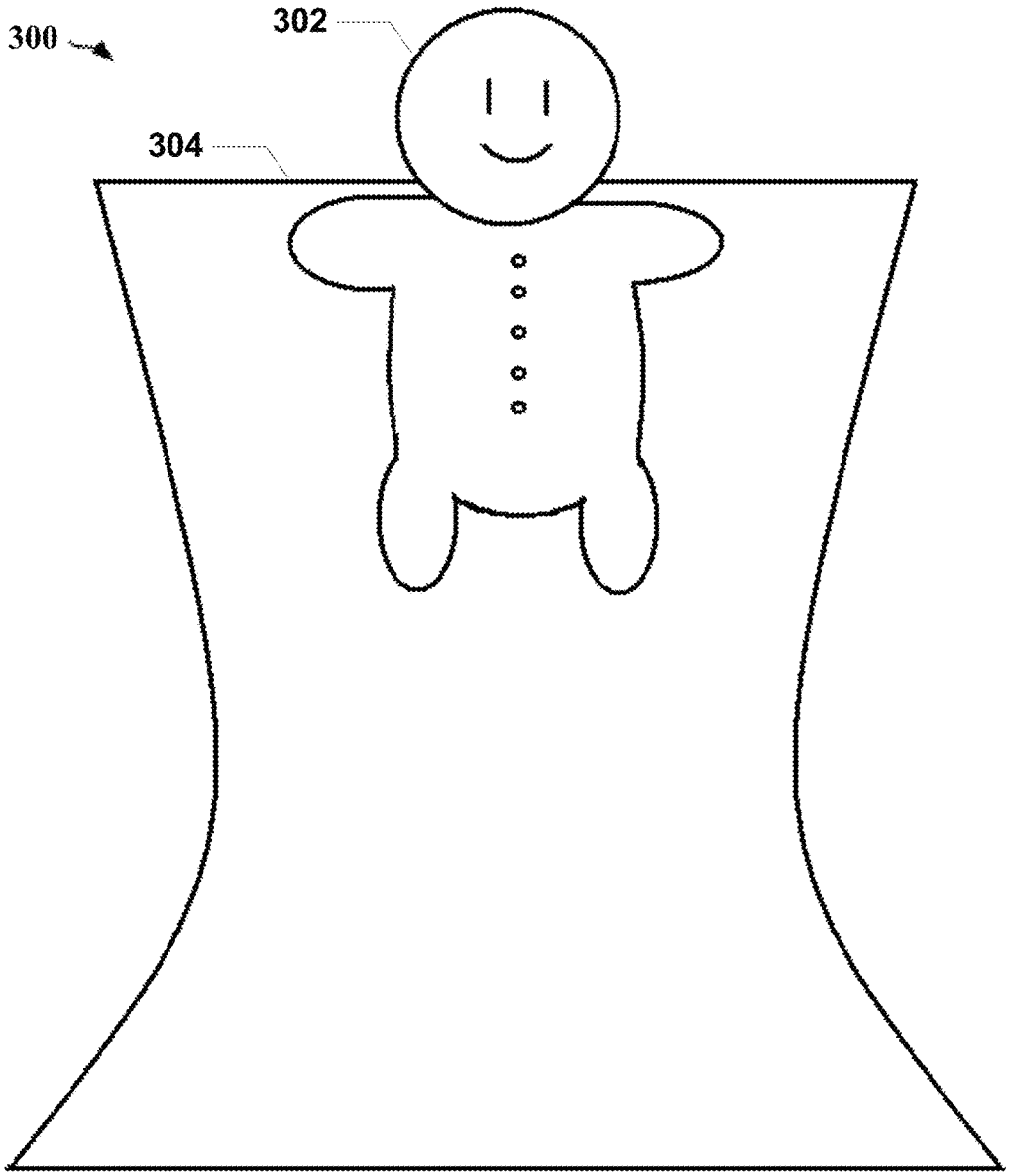
FIGS. 3A-3B show a younger infant and an older infant in a swaddle-configured blanket, according to aspects of the disclosure.
Figure 3B:
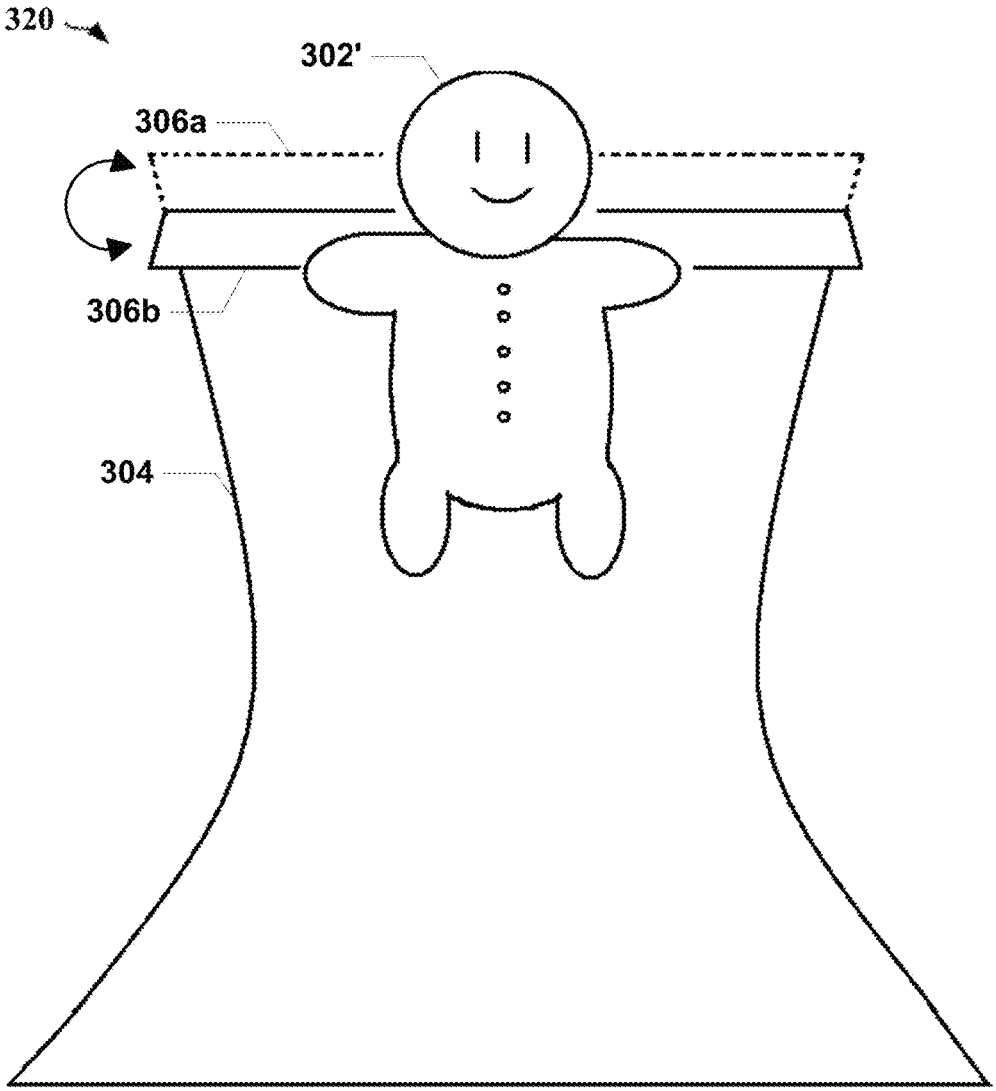

FIGS. 3A-3B show a younger infant and an older infant in a swaddle-configured blanket, according to aspects of the disclosure. In both FIGS. 3A-3B, a swaddle-configured blanket 304 is positioned underneath an infant 302. For simplicity, the main design 200 of FIG. 2A is used for the swaddle-configured blanket 304, although any of the designs 220, 230 in FIG. 2B, FIG. 2C, respectively, may also be used.

FIG. 3A shows a diagram 300 illustrating the infant 302 being positioned over a swaddle-configured blanket 304. The infant 302 in the case of FIG. 3A is older and larger than say, a younger newborn infant, which will be shown in FIG. 3B. Therefore, no folding of the swaddle-configured blanket 304 is necessary. If the infant 302 is somehow small, and not a newborn, then the folding technique shown in FIG. 3B may also be used.

FIG. 3B shows a diagram 320 illustrating a smaller infant 302' being positioned over the swaddle-configured blanket 304, which has its top portion 306*a* folded down into a folded top portion 306*b* in order to accommodate the smaller size of the smaller infant 302'. Size adjustments such as this can be made to the swaddle-configured blanket 304 in order to better accommodate the size of an infant, be the infant regular sized as the infant 302 or a smaller infant 302'.

FIGS. 4A-4H show images of different steps of the process to fold a swaddle-configured blanket 304 into a swaddle, according to aspects of the disclosure. Again, in FIGS. 4A-4H, a swaddle-configured blanket 304 is positioned underneath an infant 302. For simplicity, the main design 200 of FIG. 2A is used for the swaddle-configured blanket 304, although any of the designs 220, 230 in FIG. 2B, FIG. 2C, respectively, may also be used.

Figure 4A:
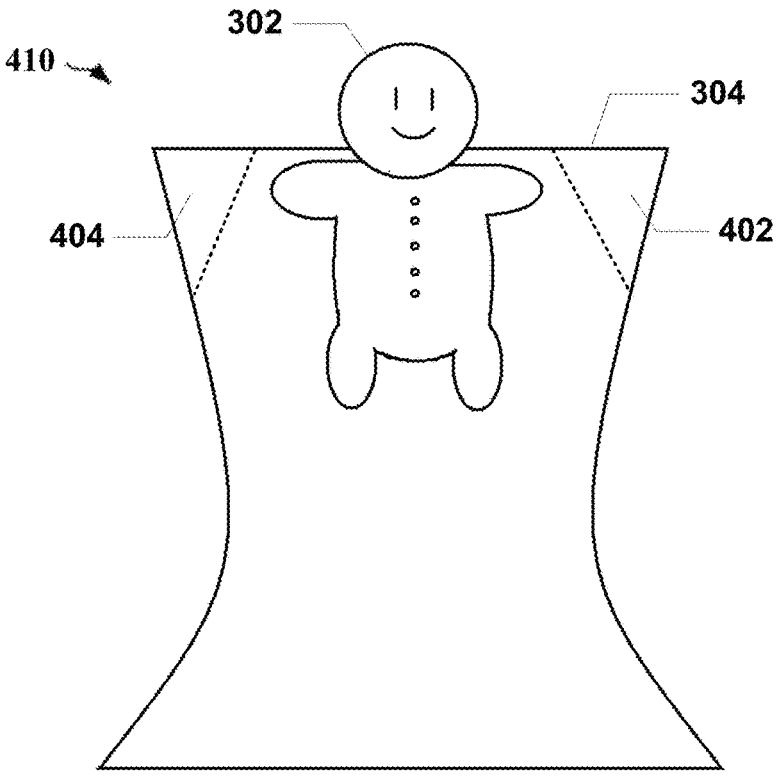
FIGS. 4A-4H show images of different steps of the process to fold a swaddle-configured blanket into a swaddle, according to aspects of the disclosure.

FIG. 4A shows a diagram 410 illustrating the infant 302 over the swaddle-configured blanket 304. A first corner 402 and a second corner 404 of the swaddle-configured blanket 304 are also shown. FIG. 4A is also similar to FIG. 2A.

Figure 4B:
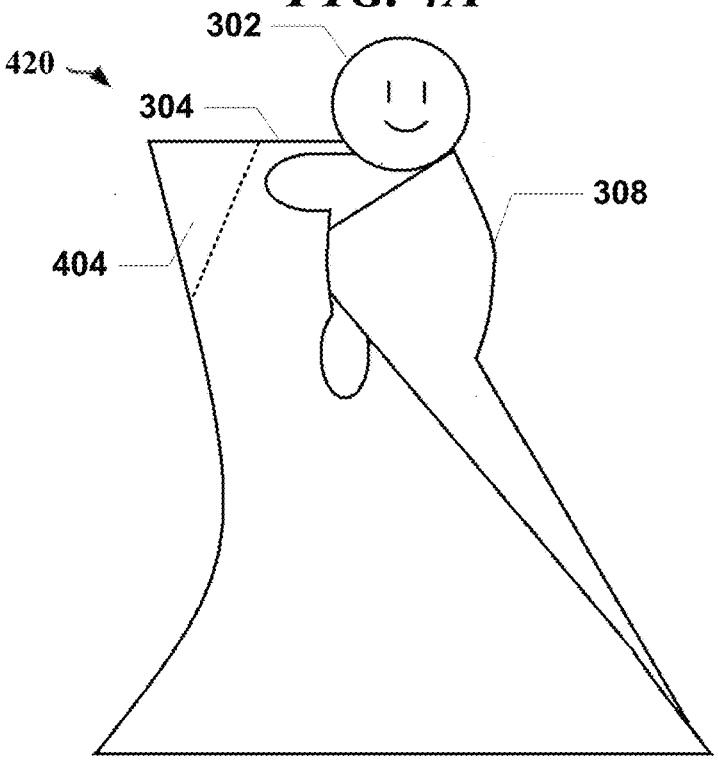

FIG. 4B shows a diagram 420 illustrating the first corner 402 of the swaddle-configured blanket 304 being folded over the front of the infant 302 in order to form a first layer 308.

Figure 4C:
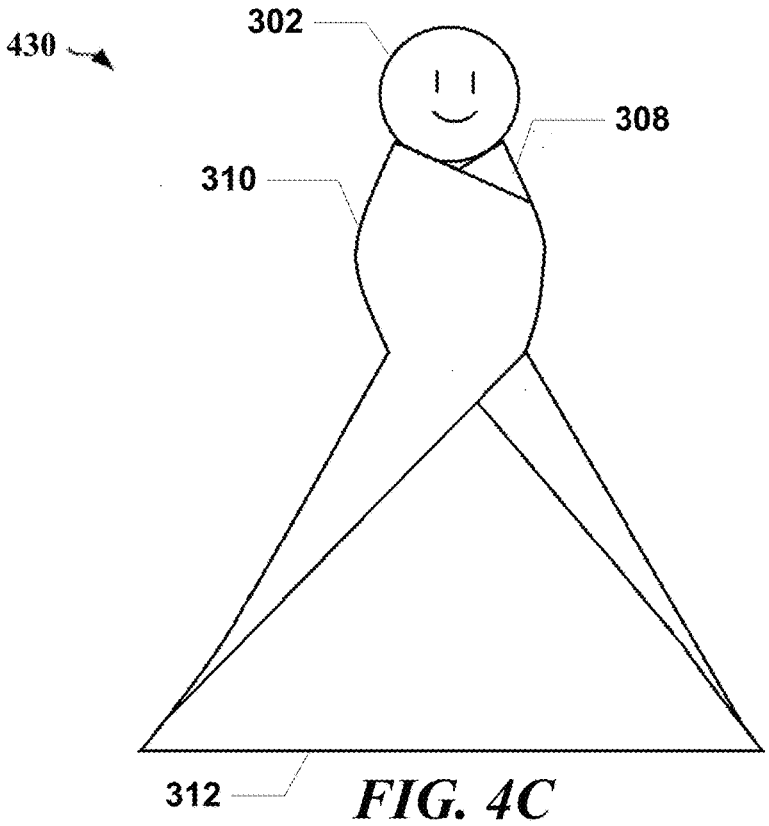

FIG. 4C shows a diagram 430 illustrating the second corner 404 of the swaddle-configured blanket 304 being folded over the front of the first layer 308 in order to from a second layer 310. A bottom edge 312 is visible.

Figure 4D:
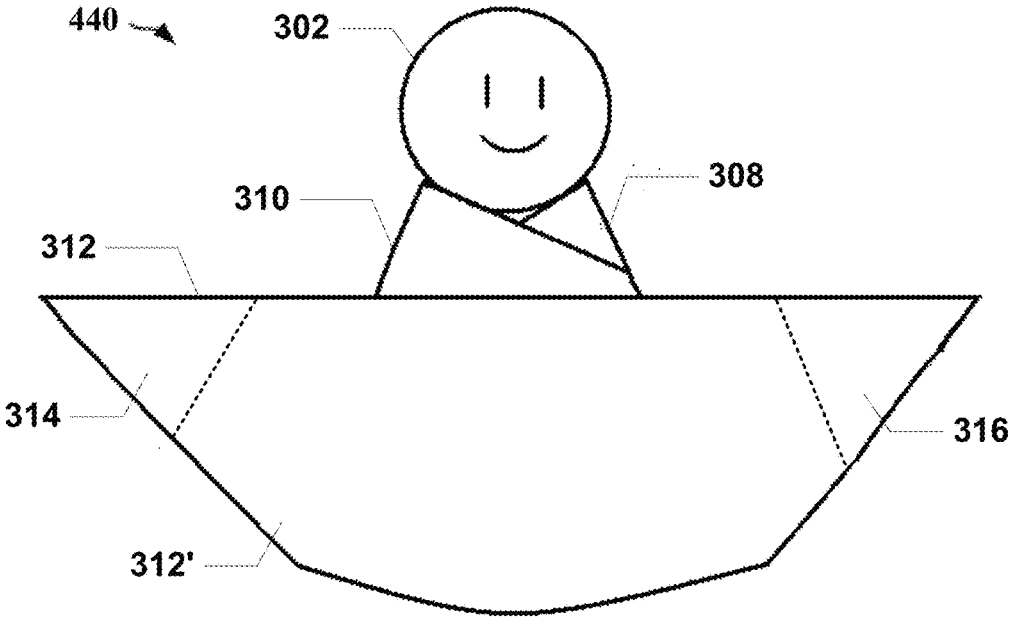

FIG. 4D shows a diagram 440 illustrating the bottom edge 312 being flipped over entirely and folded over the second layer 310. A flipside of the bottom edge 312' is visible, which contains a third corner 314 and a fourth corner 316.

Figure 4E:
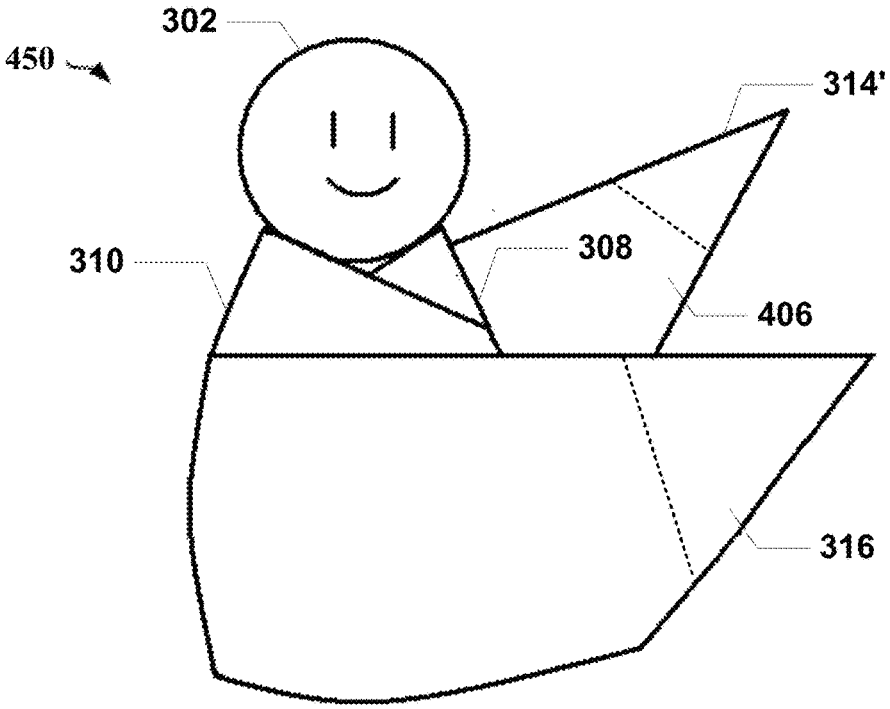

FIG. 4E shows a diagram 450 illustrating the third corner 314 being folded behind the bottommost layer (the second layer 310) covering the infant 302 to form a third layer 406, which comes out and extends a flipside of the third corner 314'. The fourth corner 316 is still visible.

Figure 4F:
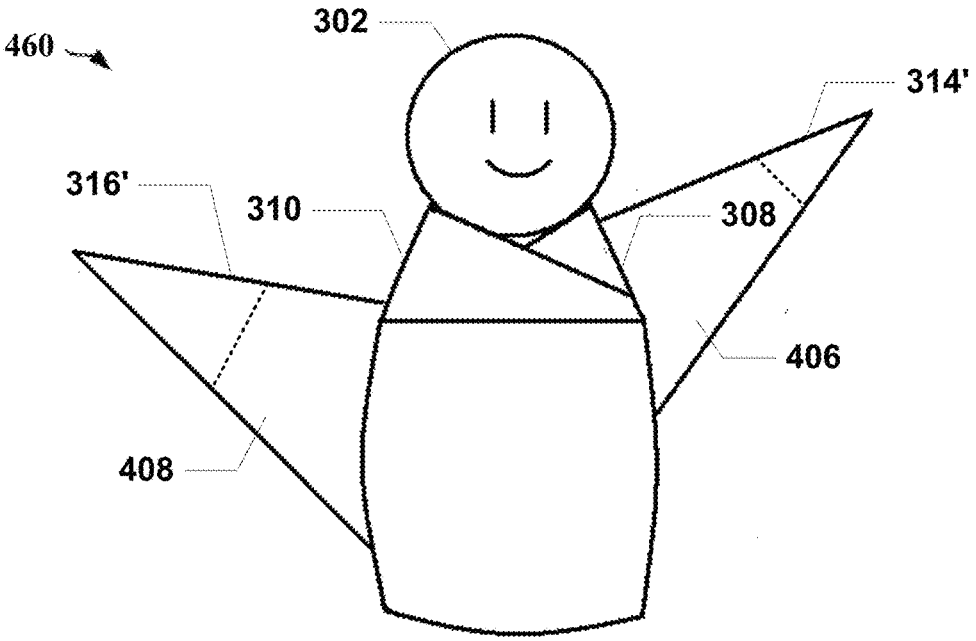

FIG. 4F shows a diagram 460 illustrating the fourth corner 316 being folded behind the bottommost layer (the third layer 406) covering the infant 302 to form a fourth layer 408, which comes out and extends a flipside of the fourth corner 316'.

Figure 4G:
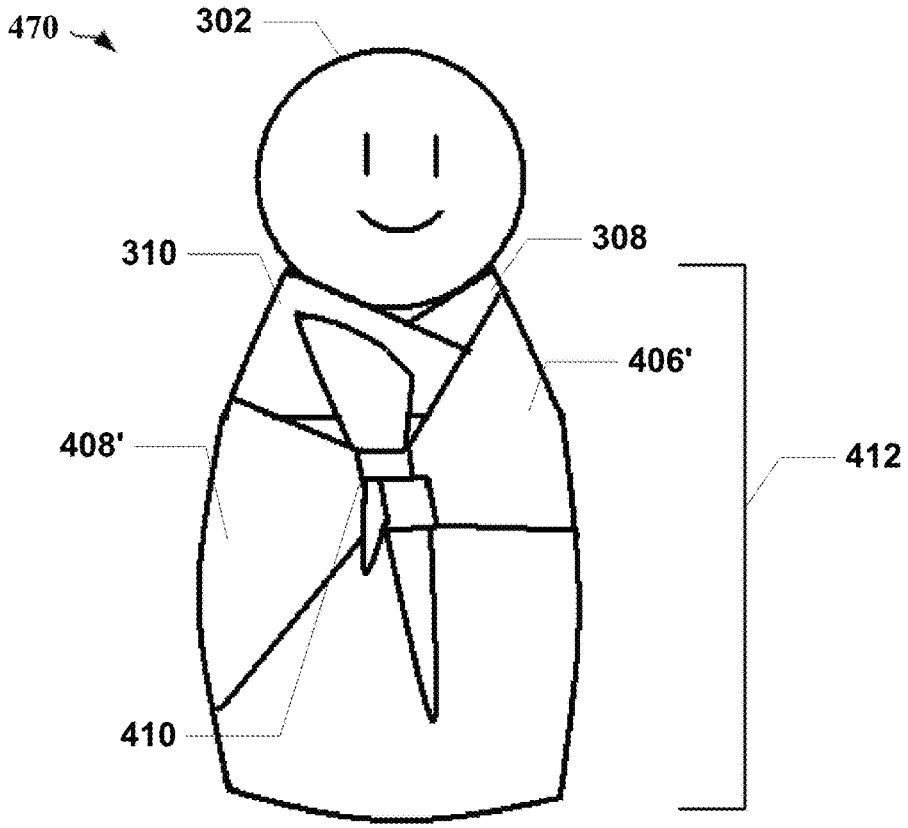

FIG. 4G shows a diagram 470 illustrating the flipside of the third corner 314' and the flipside of the fourth corner 316' being tied together to form a knot 410, and also the flipside of the third layer 406' and the flipside of the fourth layer 408'. The first layer 308 and the second layer 310 are also still visible. Everything tied together by the knot 410 also forms the swaddle 412.

Figure 4H:
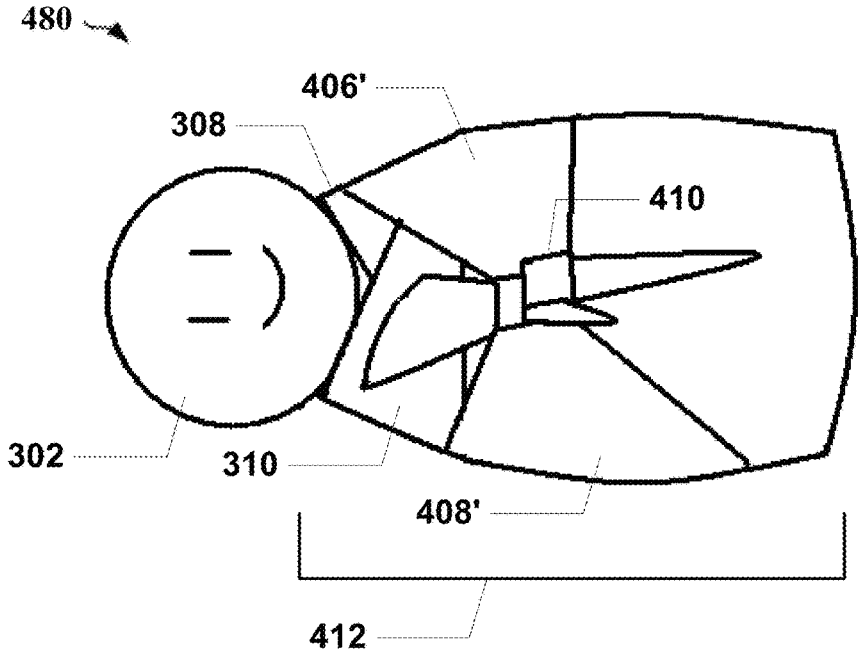

FIG. 4H shows a diagram 480, which is just the lateral representation of diagram 470 in FIG. 4G. Diagram 480 illustrates that the infant 302 can be conveniently secured in the swaddle 412 while laying down, and can also be carried in the same manner. When the knot 410 is in the middle of the swaddle 412, as shown in FIGS. 4G-4H, then a person can carry the infant 302 in the swaddle 412 without the knot 410 getting in the way.

Figure 5A:
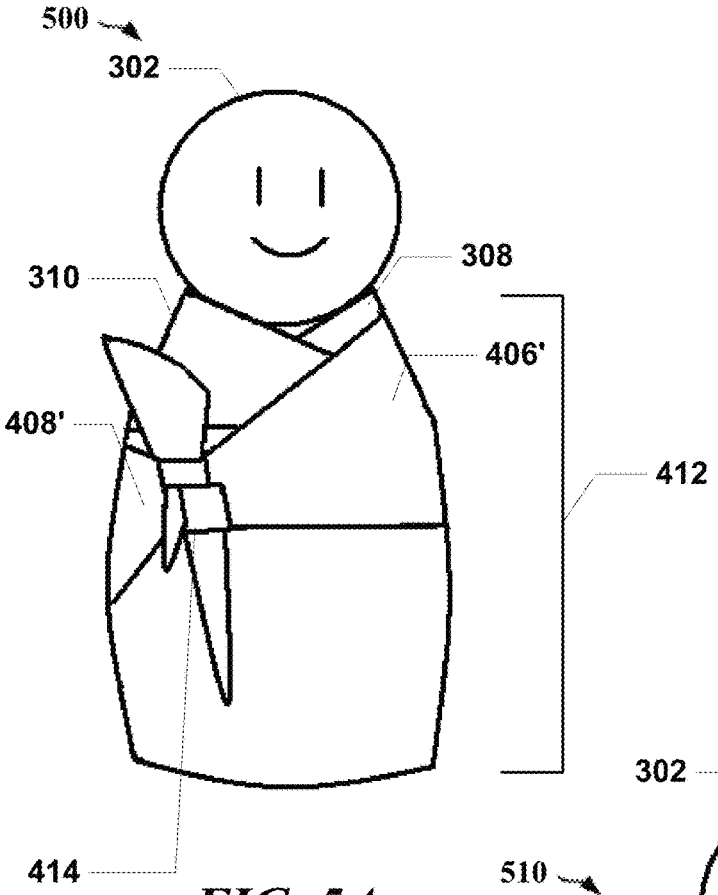
FIGS. 5A-5B show swaddle-configured blankets with knots arranged on different sides, according to aspects of the disclosure.
Figure 5B:
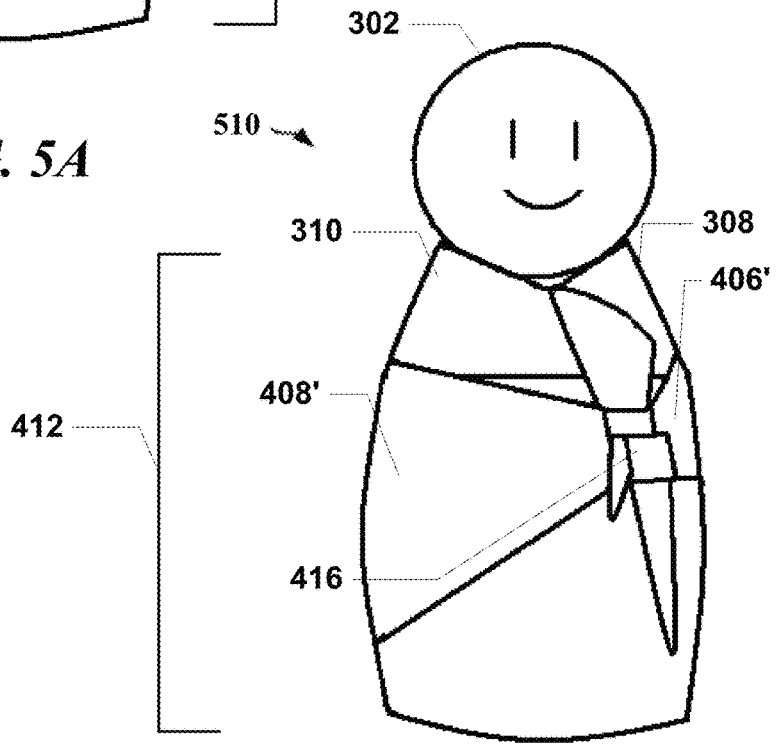

FIGS. 5A-5B show swaddle-configured blankets with knots arranged on different sides, according to aspects of the disclosure.

FIG. 5A shows a left-side positioned knot 414 in the swaddle 412. Every other component is similarly placed as in FIGS. 4G-4H. FIG. 5B shows a right-side positioned knot 416 in the swaddle 412. Every other component is similarly placed as in FIGS. 4G-4H. The placement of the knot can also be near the top or bottom or any portion of the swaddle 412, although these configurations are not shown because the number of places the knot can be tied in are potentially numerous. A person may hold the swaddled infant with their right arm if the swaddle 412 has a right-side positioned knot 416, with the non-knot side contacting the left side of the holder, with no interference. Likewise, a person may hold the swaddled infant with their left arm if the swaddle 412 has a left-side positioned knot 416, with the non-knot side contacting the right side of the holder, with no interference. Furthermore, the knot also does not cause any interference if it is in the center of the swaddle 412, in either the right-sided or left-sided situation. If the knot is not in the way of the infant, the infant will not experience any discomfort. For example, if the infant is held in the left arm, the infant is pressing against the right side of the body of the holder. That means that the knot should be only on the left or the center of the infant's body. The opposite applies to someone who holds an infant in their right arm, and similar principles apply to the top/bottom portions of the swaddle.

Figure 6:
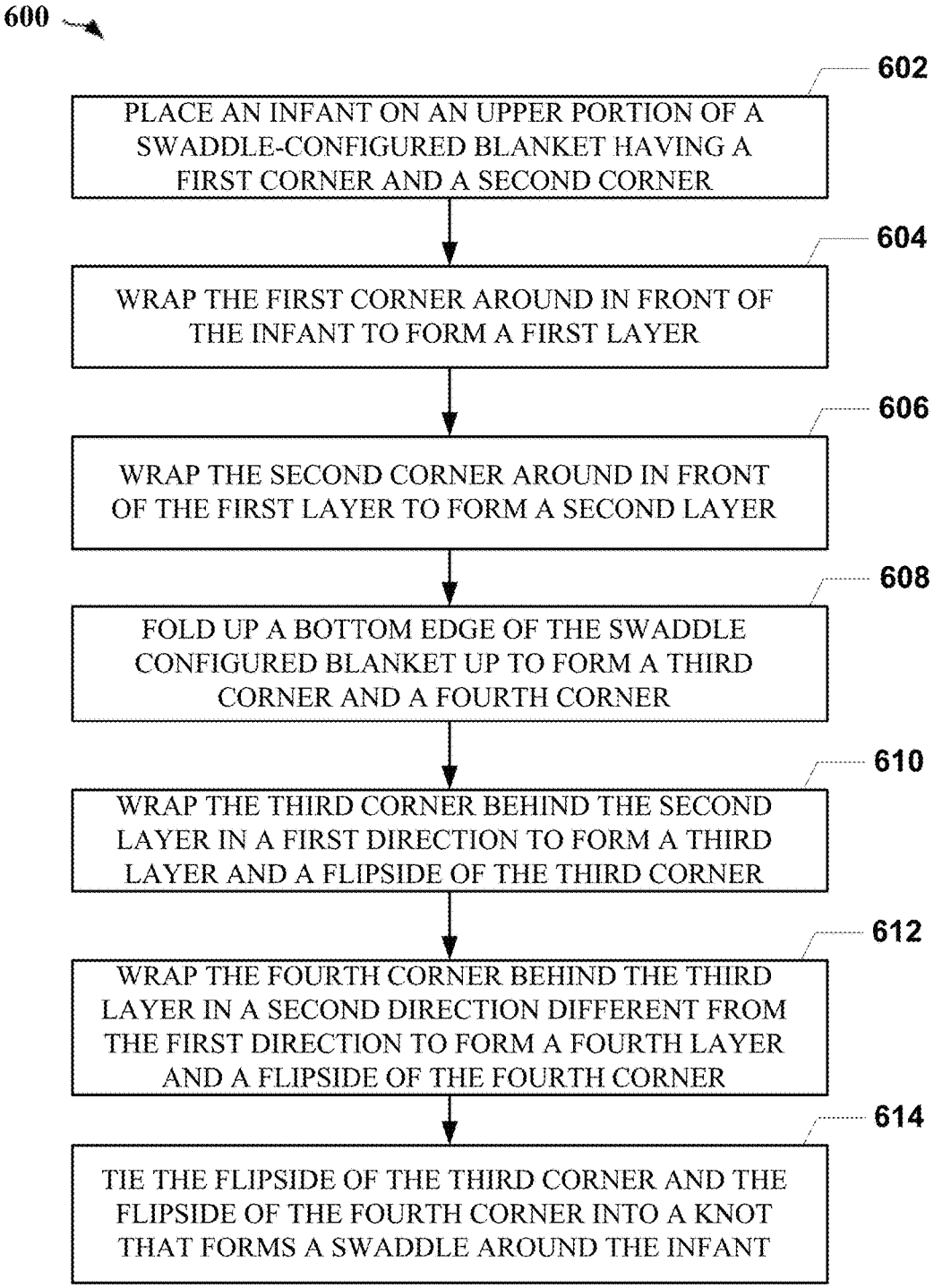
FIG. 6 shows a process flowchart of a method to fold a swaddle-configured blanket into a swaddle, according to aspects of the disclosure.

FIG. 6 shows a process flowchart 600 of a method to fold a swaddle-configured blanket into a swaddle, according to aspects of the disclosure. In box 602, an infant is placed on an upper portion of a swaddle-configured blanket having a first corner and a second corner. In box 604, the first corner is wrapped around in front of the infant to form a first layer. In box 606, the second corner is wrapped around in front of the first layer to form a second layer. In box 608, a bottom edge of the swaddle-configured blanket is folded up to form a third corner and a fourth corner. In box 610, the third corner is wrapped behind the second layer in a first direction to form a third layer and a flipside of the third corner. In box 612, the fourth corner is wrapped behind the third layer in a second direction different from the first direction to form a fourth layer and a flipside of the fourth corner. In box 614, the flipside of the third corner and the flipside of the fourth corner are tied into a knot that forms a swaddle around the infant.

In one implementation, tying the flipside of the third corner and the flipside of the fourth corner into the knot that forms the swaddle around the infant includes tying the flipside of the third corner and the flipside of the fourth corner into the knot in a specific region of the swaddle, the specific region comprising the right side, the left side, the bottom and the top of the swaddle.

In one implementation, placing the infant on the upper portion of the swaddle-configured blanket includes placing the infant so that the infant's neck is resting along a first edge that is the topmost edge of the swaddle-configured blanket.

In one implementation, placing the infant on the upper portion of the swaddle-configured blanket includes placing the infant so that the infant's head is resting on a top portion of the swaddle-configured blanket, the top portion extending downwards from a first edge that is the topmost edge of the swaddle-configured blanket to a line of the swaddle-configured blanket that contacts the infant's neck. Placing the infant on he upper portion of the swaddle-configured blanket also includes folding the top portion downwards into a folded top portion so that the folded top portion contacts the infant's neck.

In one implementation, the bottom edge is a ribbon that includes a first ribbon end and a second ribbon end.

In another implementation, the process of forming a swaddle for an infant out of a swaddle-configured blanket includes folding up a ribbon that includes a first ribbon end and a second ribbon end, wrapping the first ribbon end and second ribbon end around the infant; and tying the first ribbon end and the second ribbon end into a knot that forms the swaddle around the infant.

In another implementation, wrapping the first ribbon end and the second ribbon end around the infant includes: wrapping the first ribbon end around the infant in a first direction; and wrapping the second ribbon end around the infant in a second direction.

In another implementation, tying the first ribbon end and the second ribbon end into the knot that forms the swaddle around the infant includes: tying the first ribbon end and the second ribbon end into the knot in a specific region of the swaddle, the specific region comprising the right side, the left side, the bottom and the top of the swaddle.

Additional computer hardware coupled to a mechanical folding apparatus or robot who performs swaddle folding, for example, can be programmed to fold the swaddle-configured blanket into a swaddle. Such hardware would have processors configured to run software. The software can provide instructions to any coupled machines in order to fold the swaddle-configured blanket into a swaddle. The software can also provide heat settings, temperature settings, moisture settings, and so on, in order to enhance the swaddle-folding experience. The software may also be instructions to perform the swaddling steps at a certain speed, given parameters such as the number of swaddle-configured blankets that need folding and so on. The software may be able to add visual designs to the knot/bow of a finished swaddle, or other aesthetic designs. The software may also be able to measure the size of the designated infant to use the swaddle, and adjust its folding appropriately. For example, one of the steps that can be programmed into the software includes initially folding a larger swaddle-configured blanket down to accommodate a younger newborn infant. Other variables such as color, size, shape, cutting dimensions, dimensions of the tails and edges and corners, and other such properties may be adjusted by, entered by the user via a terminal into, and programmed within the software.

In one implementation, a swaddle-configured blanket may be folded into a swaddle by an analog, mechanical swaddle folding apparatus powered by, for example, a motor or hand-powered manual crank or lever, or other similar powering apparatus.

Several processors have been described in connection with various apparatuses and methods. These processors may be implemented using electronic hardware, computer software, or any combination thereof. Whether such processors are implemented as hardware or software will depend upon the particular application and overall design constraints imposed on the system. By way of example, a processor, any portion of a processor, or any combination of processors presented in this disclosure may be implemented with a microprocessor, microcontroller, digital signal processor (DSP), a field-programmable gate array (FPGA), a programmable logic device (PLD), a state machine, gated logic, discrete hardware circuits, and other suitable processing components configured to perform the various functions described throughout this disclosure. The functionality of a processor, any portion of a processor, or any combination of processors presented in this disclosure may be implemented with software being executed by a microprocessor, microcontroller, DSP, or other suitable platform.

Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. The software may reside on a computer-readable medium. A computer-readable medium may include, by way of example, memory such as a magnetic storage device (e.g., hard disk, floppy disk, magnetic strip), an optical disk (e.g., compact disc (CD), digital versatile disc (DVD)), a smart card, a flash memory device (e.g., card, stick, key drive), random access memory (RAM), read only memory (ROM), programmable ROM (PROM), erasable PROM (EPROM), electrically erasable PROM (EEPROM), a register, or a removable disk. Although memory is shown separate from the processors in the various aspects presented throughout this disclosure, the memory may be internal to the processors (e.g., cache or register).

Computer-readable media may be embodied in a computer-program product. By way of example, a computer-program product may include a computer-readable medium in packaging materials. Those skilled in the art will recognize how best to implement the described functionality presented throughout this disclosure depending on the particular application and the overall design constraints imposed on the overall system.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

For a firmware and/or software implementation, the methodologies may be implemented with modules (e.g., procedures, functions, and so on) that perform the functions described herein. A machine-readable medium tangibly embodying instructions may be used in implementing the methodologies described herein. For example, software codes may be stored in a memory and executed by a processor unit. Memory may be implemented within the processor unit or external to the processor unit. As used herein, the term "memory" refers to types of long term, short term, volatile, nonvolatile, or other memory and is not to be limited to a particular type of memory or number of memories, or type of media upon which memory is stored.

If implemented in firmware and/or software, the functions may be stored as one or more instructions or code on a computer-readable medium. Examples include computer-readable media encoded with a data structure and computer-readable media encoded with a computer program. Computer-readable media includes physical computer storage media. A storage medium may be an available medium that can be accessed by a computer. By way of example, and not limitation, such computer-readable media can include RAM, ROM, EEPROM, CD-ROM or other optical disk storage, magnetic disk storage or other magnetic storage devices, or other medium that can be used to store desired program code in the form of instructions or data structures and that can be accessed by a computer; disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a substrate or electronic device. Of course, if the substrate or electronic device is inverted, above becomes below, and vice versa. Additionally, if oriented sideways, above and below may refer to sides of a substrate or electronic device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

What is claimed is:

1. A swaddle-configured blanket having four edges comprising:

a first edge having a first length;

a second edge parallel to the first edge having a second length different than the first length;

a third edge coupled to the first edge and the second edge, the third edge forming a first corner with the second edge;

a fourth edge coupled to the first edge and the second edge, the fourth edge forming a second corner with the second edge; and the first corner and the second corner being configured to tie into a knot, wherein the third edge and the fourth edge are both curved, the third edge having a point where its curve changes direction called the first turning point and the fourth edge having a point where its curve changes direction called the second turning point, further wherein a turning point span is a distance between each of the first and second turning points and a height is a distance between the first edge and the second edge, and further wherein the turning point span is greater than the first length but smaller than the second length.

2. The swaddle-configured blanket of claim 1, wherein the second length is greater than the first length.

3. The viewing device of claim 1, wherein the turning point span is smaller than the first length and the second length.

4. The swaddle-configured blanket of claim 1, wherein the first length is approximately 42 inches, the second length is approximately 59 inches, the height is approximately 42 inches, and the turning point span is approximately 33 inches.

5. The swaddle-configured blanket of claim 1, wherein the first length is approximately 42 inches, the second length is approximately 59 to 70 inches, the height is approximately 42 inches, and the turning point span is approximately 42 inches.

6. The swaddle-configured blanket of claim 1, wherein the swaddle-configured blanket is made out of material comprising jersey, muslin, flannel, cotton, organic cotton, woven cotton or other woven fabrics.

* * * * *